US005255737A

United States Patent [19]

Gentry et al.

[11] Patent Number: 5,255,737

[45] Date of Patent: Oct. 26, 1993

[54] HEAT EXCHANGER WITH FLOW DISTRIBUTION MEANS

[75] Inventors: Cecil C. Gentry; William A. McClintock, both of Bartlesville, Okla.

[73] Assignee: Phillips Petroleum Company, Bartlesville, Okla.

[21] Appl. No.: 549,879

[22] Filed: Jul. 9, 1990

[51] Int. Cl.[5] ..... F28F 9/24

[52] U.S. Cl. ..... 165/159; 165/162

[58] Field of Search ..... 165/159, 160, 161, 162

[56] References Cited

U.S. PATENT DOCUMENTS

| | | | |
|---|---|---|---|
| 2,070,189 | 2/1937 | Webster | 165/159 |
| 2,805,049 | 9/1957 | Katholi | 165/159 |
| 3,870,476 | 3/1975 | Marsch | 165/161 |
| 4,289,198 | 9/1981 | Young | 165/159 |
| 4,398,595 | 8/1983 | Small | 165/159 |
| 4,450,904 | 5/1984 | Volz | 165/162 |
| 4,578,850 | 4/1986 | Kerr et al. | 165/158 |
| 4,588,024 | 5/1986 | Murray et al. | 165/91 |
| 4,593,757 | 6/1986 | Clintock | 165/162 |
| 4,709,755 | 12/1987 | Gentry et al. | 165/160 |
| 4,828,021 | 5/1989 | Small | 165/162 |

FOREIGN PATENT DOCUMENTS

| | | | |
|---|---|---|---|
| 2217287 | 11/1973 | Fed. Rep. of Germany | 165/172 |
| 3136865 | 3/1983 | Fed. Rep. of Germany | 165/159 |
| 1296988 | 5/1962 | France | 165/159 |
| 202497 | 12/1982 | Japan | 165/159 |

*Primary Examiner*—John Rivell
*Assistant Examiner*—L. R. Leo
*Attorney, Agent, or Firm*—Richmond, Phillips, Hitchcock & Carver

[57] ABSTRACT

A shell and tube heat exchanger is disclosed in which the distribution of the fluid on the shell is substantially improved by the positioning of flow-restrictive disks on the tubes near the inlet and outlet regions of the exchanger. Positioning of the disks in other regions of the exchanger is also disclosed in order to create turbulence and increased beat transfer.

7 Claims, 4 Drawing Sheets

HEAT EXCHANGER WITH FLOW DISTRIBUTION MEANS

BACKGROUND

1. Field of the Invention

The present invention relates to heat exchangers of the tube and shell type wherein a first fluid passes within a plurality of hollow, heat transfer tubes while a second fluid passes in indirect heat exchange with the first fluid through the spacing between the transfer tubes and the surrounding shell of the exchanger. In such exchangers, there has long been a problem of maldistribution of the fluid flow through the shell side of the exchanger. More specifically, there is a distinct tendency of the fluid introduced at the inlet of the shell side to flow in the shortest, most direct path to the outlet region of the exchanger instead of flowing uniformly in counter current heat exchange with the fluid flowing within the heat transfer tubes. While this maldistribution problem may exist in exchangers of various sizes and relative dimensions, it is particularly acute in heat exchangers in which the inlet and outlet are longitudinally spaced in the same direction in which the transfer tubes extend, and can be particularly severe in exchangers having relatively large diameters and relatively short longitudinal lengths.

2. Prior Art

U.S. Pat. No. 4,593,757 assigned to the Phillips Petroleum Company represents one prior art attempt to minimize the above-indicated maldistribution problem by varying the number and position of the support rods in a rodbaffle heat exchanger such that fewer rods are positioned adjacent the inlet and outlet regions of the exchanger than at other portions so that the flow of the shell side fluid is forced to flow in a more uniform and desirable direction.

Another attempt to solve the above-indicated maldistribution problem is disclosed in U.S. Pat. No. 4,289,198 assigned to the Phillips Petroleum Company. This patent discloses the use of rod baffle means in the form of a set of flow deflecting or directing rods positioned in the spaces between adjacent rows of tubes in order to provide improved shell side fluid distribution.

A further attempt to improve the overall distribution of the beat exchange fluid in the shell side of the exchanger is disclosed in U.S. Pat. No. 4,588,024 assigned to the Phillips Petroleum Company. This patent discloses the use of rectangular plates between pluralities of helical tubes so as to block the flow of the shell side fluid in some regions and force the flow through other regions of the shell side passage ways.

Each of the above-indicated disclosures has been successful in improving the shell side flow distribution; however, each has had its own disadvantages such as, for example, time-consuming and difficult manufacturing steps, and/or undesirably high cost of the exchanger.

The present invention solves the maldistribution problem on the shell side of a tube and a shell exchanger by the simple provision of a plurality of disks surrounding selected heat transfer tubes. The discs are in the path of shortest distance between the inlet and outlet of the exchanger, and are concentrated in the inlet and outlet regions so as to force more flow into a more uniformly distributed and more effective beat transfer pattern. The disks of the present invention are relatively inexpensive and are easy to install on the tubes during the assembly of the exchanger. As a result, they substantially improve the flow distribution at lower cost and with easier manufacturing steps than has been previously possible.

SUMMARY OF THE INVENTION

The present invention improves the flow distribution on the shell side of tube and shell heat exchangers by the provision of a plurality of flow restricting disks positioned on the tubes in the shortest path between the inlet and outlet of the exchanger, and concentrated in the inlet and outlet regions.

DETAILED DESCRIPTION

Figure 1:
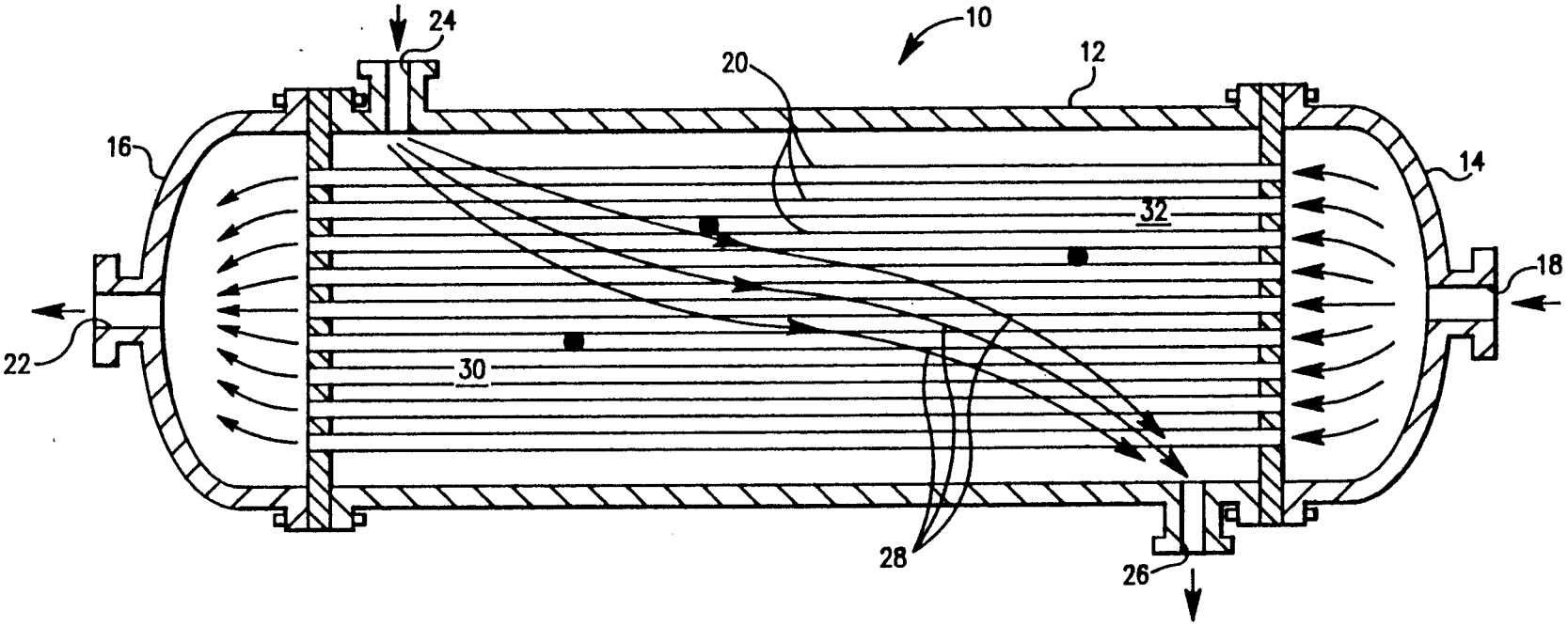
FIG. 1 is a side elevational view, in cross-section, illustrating the tendency of the shell side fluid to pass through the shortest path between the inlet and outlet regions of the exchanger and thereby cause maldistribution of the overall shell side flow.

Referring first to FIG. 1, a tube and shell beat exchanger 10 is illustrated as comprising a shell 12 connected at opposite ends to inlet and outlet endcaps 14 and 16, respectively. Inlet endcap 14 includes a fluid inlet 18 through which the first fluid is admitted to the exchanger and flows through the inlet header to each of the plurality of hollow, heat transfer tubes 20. The flow of the fluid exits from the plurality of tubes into the outlet header in endcap 16 and then flows out of the exchanger through outlet passage 22.

The shell side fluid is admitted to the exchanger through an inlet passage 24 and exits through an exit or discharge passage 26. As indicated by illustrative flow lines 28, the natural tendency of the shell side fluid is to flow from inlet 24 to outlet 26 in the shortest path, which is the path of least flow resistance. As result, there tends to be significantly less flow in the regions identified as 30 and 32 which are at the same ends, but on opposite sides or corners, of the exchanger from inlet 24 and outlet 26, respectively. Accordingly, it is the object of this invention to increase the flow in regions 30 and 32 and thereby approach an idealized flow pattern in which all of the shell side fluid flows from left to right, as viewed in FIG. 1, in counter current heat exchange with the fluid within the beat transfer tubes flowing in the opposite direction.

Figure 2:
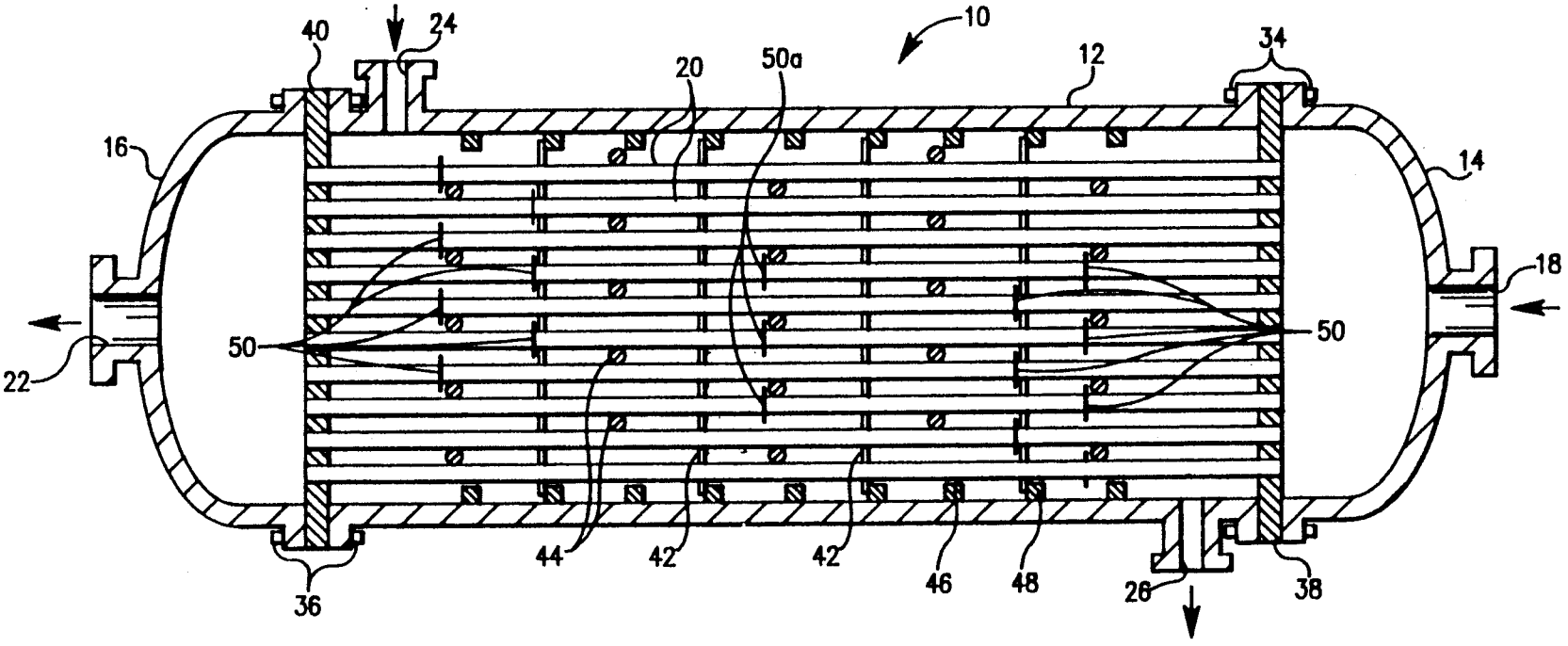
FIG. 2 is a side elevational view in cross section showing a simplified exchanger provided with flow restricting disks located along the shortest path between the inlet and outlet of the exchanger, and concentrated in the inlet and outlet regions.

Reference is now made to FIG. 2 in which the elements already described in FIG. 1 have the same numerals in FIG. 2, and therefore, need not be described again. Inlet endcap 14 and outlet endcap 16 are shown as being bolted to the cylinder shell 12 by a plurality of bolts 34 and 36, respectively, and a pair of inlet and outlet tube sheets 38 and 40 are held in position by the same bolts 34 and 36. It will be apparent that heat transfer tubes 20 extend the full length of the elongated exchanger between inlet tube sheet 38 and outlet tube sheet 40 so that the fluid introduced through inlet 18 is passed through the tubes and exits through discharge passage 22.

The particular type of exchanger illustrated in FIG. 2 is of the so-called rodbaffle type in which the heat transfer tubes 20 are spaced apart and supported by a plurality of vertical rods 42 and horizontal rods 44. The ends of the horizontal and vertical rods are welded or otherwise secured to baffle rings 46 and 48, respectively. In FIG. 2 only a few of the many support rods and exchanger tubes are shown for the sake of clarity as will subsequently become clear from the description of FIG. 3.

As further shown in FIGS. 2–6, the present invention provides a plurality of flow restricting disks 50 which are connected to the beat transfer tubes 20 and positioned at radially and axially spaced locations in the region of the theoretical flow paths 28 previously described. That is, the disks are located at positions along the theoretical flowpaths 28 and are preferably concentrated at positions along the theoretical flowpaths 28 and the inlet and outlet regions. It will also be noted, as most clearly shown in FIGS. 2 and 3, that the disks are concentrated in the upper portion adjacent the inlet 24 and in the lower portion adjacent outlet 26. Since the disks 50 reduce the cross sectional flow area where they are present, the shell side fluid is forced to flow more uniformly throughout the exchanger. Thus, the counter current flow is increased in the regions 30 and 32 so as to increase the heat transfer efficiency of the exchanger.

Figure 3:
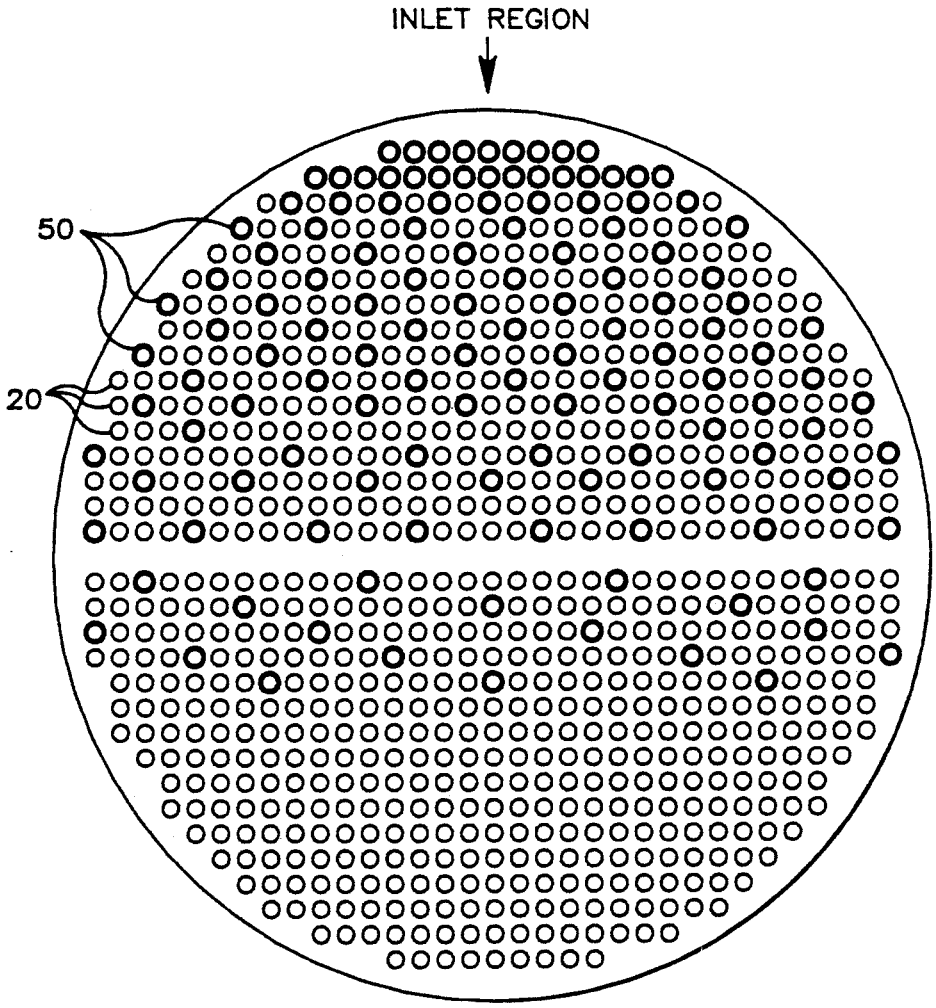
FIG. 3 is a sectional view of a bundle of heat exchanger tubes in a typical rod baffle exchanger showing one distribution pattern of the discs of the present invention in the inlet region.

While FIG. 2 is a simplified illustration showing only a few of the exchanger tubes 20 and disks 50, sectional view FIG. 3 is a more realistic illustration of the number of tubes 20 and disks 50 in one, typical exchanger. In this view it will also be noted that the preferred embodiment of the invention employs a pattern of the positions of the disks such that the density; i.e., the number of the disks per unit of cross sectional area, increases in the direction toward the inlet. Similarly, if the cross section were to be taken at the opposite, discharge end of the exchanger, the density of the disks would increase in the direction of the outlet.

While the primary purpose and function of the disks is to correct the maldistribution of flow as has been previously described, it should also be understood that the disks inherently disrupt the flow and cause turbulence of the fluid in the shell side of the exchanger. Such turbulent flow further enhances the heat transfer rate through the tubes in addition to the enhancement of heat transfer rate resulting from the improved distribution of the shell-side flow. Because of the turbulent effect, some disks may also be positioned in other portions of the exchanger such as in the mid-section as illustrated by disks 50A in FIG. 2. Thus, it is to be understood that the present invention includes the use and placement of the disks for improved flow distribution, as well as for the creation of turbulence wherever that may be desired in the exchanger.

Figure 4:
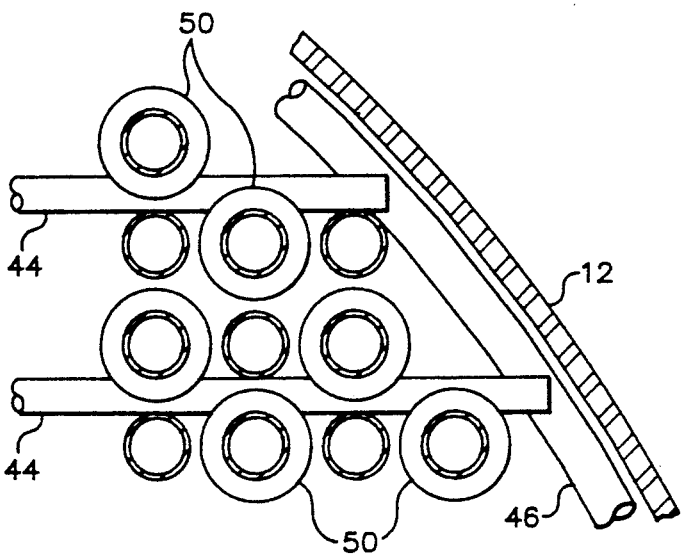
FIG. 4 is a fragmentary view of a few rods, exchanger tubes and disks of the present invention enlarged to show the relative sizing.
Figure 5:
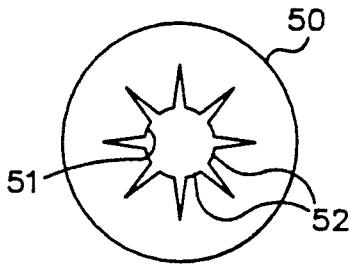
FIG. 5 is an elevational view showing the details of one preferred embodiment of a flow restricting disk.
Figure 6:
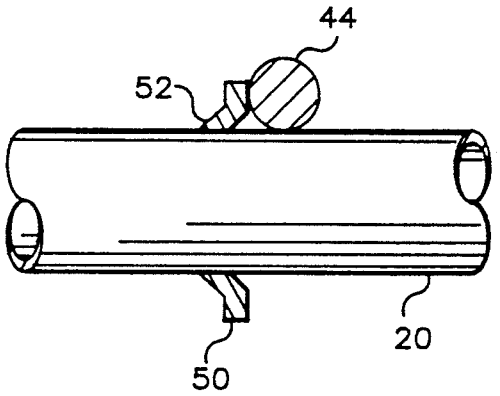
FIG. 6 is a fragmentary, side elevational view showing the disk of FIG. 5 mounted on one heat transfer tube adjacent one of the support rods.

Referring to FIGS. 4–6, the disks may be composed of sheet metal, or of various other metals such as carbon steel, stainless steel or titanium. The disks may have thicknesses in the range of 1/16 to 3/16 inches, and have diameters in the range of one to three end a half inches, depending upon the size of the tubes 20 and the corresponding spacing between the tubes 20 which is determined by the diameter of the rods 42 and 44 which are usually in the range of ¼ to ¾ of an inch. Thus, the diameter of the disks is in the range of being (a) slightly larger than the outer diameter of the tubes to being (b) the outer diameter of the tubes plus two times the diameters of the rods. Most preferably, the diameter of the disks is approximately the outer diameter of the tubes plus one times the diameter of the rods as illustrated in FIG. 4. While each of the disks shown in FIG. 4 may be welded, brazed or otherwise secured to one of the heat transfer tubes 20, alternatively they may be simply force-fitted over the tubes. That is, the disks are provided with central apertures which are only slightly smaller than the other diameter of the heat transfer tubes so as to provide a force fit. As shown in FIG. 4, they are prevented from sliding in one direction by the vertical and horizontal support rods 42 and 44, and in the other direction by the flow of the shell side fluid against them.

In the preferred embodiment of the invention, shown in FIGS. 5–6, the disk 50 may be stamped from sheet metal so as to have a star-shaped center aperture 51 and a plurality of tube-engaging tips 52. The center aperture is smaller than the diameter of the heat transfer tubes such that the tips 52 are bent when the tubes are slid through the apertures of the disks. In this embodiment, there is no need for welding, brazing or other means of physical attachment to the tubes since the disks are prevented from moving to the right, as viewed in FIG. 6, by the support rod 44, and they are prevented from moving in the opposite direction by the bent, pointed tips 52 which frictionally engage the tubes and lock the disks in their assembled position.

From the foregoing description, which is purely illustrative of the principles of the invention, and is not intended to limit the invention other than as set forth in the following claims, it will be apparent that the present invention provides a simple, easy to manufacture and low cost means whereby the maldistribution in tube and shell beat exchangers may be substantially and significantly improved at a very low cost of manufacture. It will also be apparent that the broader aspects of the invention are not limited to heat exchangers of the rodbaffle type since the disks may be secured to the heat transfer tubes by any suitable means. However, in the preferred embodiment of the invention, the rods and the particular embodiment of the disks shown in FIGS. 5–6 cooperate to lock the disks in their fixed positions without any welding, brazing, or other physical means of securement. Of course, the location and spacing of the disks 50 is by no means limited to the particular positions illustrated and described, purely for purposes of example. Rather, they may be located in any region in which it is desired to reduce the flow of the shell side fluid and increase the flow of the shell side fluid in another region of the exchanger and/or create turbulence to the shell-side fluid to increase the heat transfer rate in a tube and shell exchanger.

That which is claimed is:

1. A heat exchanger having an inlet end and a longitudinally spaced outlet end, a plurality of heat transfer tubes extending longitudinally from said inlet end to said outlet end, and a plurality of flow restricting disk means mounted on some of said heat transfer tubes for restricting the shell side flow in the area of said disk means and thereby producing a more uniform flow on the shell side of the exchanger and wherein said flow restricting disk means comprise a plurality of individual disks and each of said individual disks is mounted on not more than one of said heat transfer tubes.

2. The heat exchanger as claimed in claim 1 including an inlet in said inlet end and an outlet in said outlet end, said inlet and said outlet being spaced longitudinally apart such that there is a shortest, most direct flow path therebetween, and wherein said plurality of flow restricting disk means are located on said transfer tubes and positioned such as to reduce the flow along said shortest, most direct flow path.

3. The heat exchanger as claimed in claim I wherein said flow restricting disk means have center aperture means which are smaller than the outer diameter of said heat transfer tubes whereby said flow restricting disk means are slid onto and along said beat transfer tubes.

4. The heat exchanger as claimed in claim 3 in which said heat exchanger includes a plurality of support rods for supporting said heat transfer tubes, and said flow restricting disk means positioned on and along said heat transfer tubes such that they each abut a corresponding one of said support rods.

5. The heat exchanger as claimed in claim I wherein said flow restricting disk means comprise a plurality of individual, circular disks each having a diameter in the order of one to three and a half inches.

6. The heat exchanger as claimed in claim 5 wherein said circular disks have thicknesses in the order of 1/16 to 3/16 inches.

7. A heat exchanger as claimed in claim 1 wherein each said flow restricting disk means comprises a sheet of metal having a centrally located aperture, said aperture being in the form of a star, said star forming a central hole and a plurality of tips, the size of said hole being less than the diameter of said heat transfer tubes whereby the tips are bent and firmly engage a corresponding heat transfer tube upon which said flow restricting disk means is mounted.

* * * * *